US005190108A

United States Patent [19]

Mansuy

[11] Patent Number: 5,190,108

[45] Date of Patent: Mar. 2, 1993

[54] METHOD AND APPARATUS FOR INHIBITING BIOLOGICAL FOULING OF WATER WELLS

[75] Inventor: Neil Mansuy, Kansas City, Mo.

[73] Assignee: Layne-Western Company, Inc., Shawnee Mission, Kans.

[21] Appl. No.: 746,695

[22] Filed: Aug. 19, 1991

[51] Int. Cl.[5] ..... E21B 43/12

[52] U.S. Cl. ..... 166/371; 166/68; 166/74; 166/305.1; 166/313; 166/370

[58] Field of Search ..... 166/68, 74, 90, 279, 166/305.1, 312, 313, 369, 370, 371, 372

[56] References Cited

U.S. PATENT DOCUMENTS

| | | | |
|---|---|---|---|
| 2,969,840 | 1/1961 | D'Audiffret et al. | 166/312 X |
| 3,033,784 | 5/1962 | Jones . | |
| 3,335,791 | 8/1967 | Patton | 166/371 X |
| 3,661,210 | 5/1972 | Kirk | 166/305.1 |
| 3,722,594 | 3/1973 | Smith et al. | 166/279 X |
| 3,770,058 | 11/1973 | Smedley | 166/371 X |
| 3,782,468 | 1/1974 | Kuwada | 166/369 X |
| 4,434,852 | 3/1984 | Morel et al. | 166/273 |
| 4,624,319 | 11/1986 | Van Der Borght | 166/369 |
| 4,625,803 | 12/1986 | Walhaug et al. | 166/279 |
| 4,844,156 | 7/1989 | Hesh | 166/372 X |
| 4,945,988 | 8/1990 | Payne et al. | 166/266 |

FOREIGN PATENT DOCUMENTS

| | | | |
|---|---|---|---|
| 1409703 | 1/1969 | Fed. Rep. of Germany | 166/369 |

*Primary Examiner*—George A. Suchfield

*Attorney, Agent, or Firm*—Kokjer, Kircher, Bowman & Johnson

[57] ABSTRACT

Biological fouling of water wells is inhibited by replacing the air in the well column with an anoxic gas such as nitrogen to deprive aerobic bacteria of oxygen. The anoxic gas is applied from a cylindrical tank at the surface and through a gas pipe extending from the tank down into the well casing. The well casing is sealed near the top to prevent air infiltration and maintain a positive gas pressure. The anoxic gas is applied at a slightly positive pressure to maintain the well column filled with it and to prevent air penetration. The gas can be supplied to the well column only or to both the well column and the aquifer so that a blanket of gas in the area of the well inhibits air penetration of the water from the unsaturated cover layer above the aquifer.

15 Claims, 1 Drawing Sheet

METHOD AND APPARATUS FOR INHIBITING BIOLOGICAL FOULING OF WATER WELLS

FIELD OF THE INVENTION

This invention relates generally to the field of water wells and more particularly to the application of anoxic gas to a well in order to displace air, thereby depriving aerobic bacteria of oxygen and preventing the bacteria from causing biological fouling of the well.

BACKGROUND OF THE INVENTION

The quality and performance of a water well can deteriorate for a number of reasons. The water quality can be adversely affected, the aquifer characteristics can degrade, operational procedures can be poor, or the well can be improperly designed or constructed. Corrosion, encrustation and biological fouling of wells are recognized problems that can lead to degradation in the well performance.

Biological fouling is a particularly common cause of well deterioration. It has been found that 75% to 80% of wells that experience deterioration have a high level of bacterial activity. In most wells that are subject to bacteriological plugging, bacterial slimes are found together with inorganic precipitates (such as iron and manganese oxides and hydroxides) and fines (such as silt, clay and/or sand). The bacterial slime typically acts as a glue which traps and holds the fines and chemical precipitates together and thus promotes the formation of biological masses that can substantially reduce the water yield of the well and deteriorate water quality.

Biological fouling in groundwater supply systems creates numerous problems that adversely affect the well performance. For example, biofouling results in increased frictional resistance and decreased flow area through the well screens. Voids in the gravel pack around the well and elsewhere in the aquifer can become plugged and decrease the flow capacity of the aquifer. The well intake screen can be plugged, and the screen, casing and pump column pipe are subjected to increased corrosion. Restricted flow through the pump can cause operational problems, and the pump impeller and discharge piping can become clogged by biological masses. Finally, biofouling degrades the water quality in its taste, color and odor.

Although there are many different physical and chemical factors that influence the rate of aquifer plugging, the availability of oxygen is the most important factor in stimulating the biological growth activity that is the principal cause of biomass formation. Most of the bacteria that contribute to well plugging are aerobic and require oxygen for growth and development. Also, organic compounds are necessary to support microbial growth. Because organic material is often concentrated at air-water or solid-water interfaces, reduction of these interfaces can reduce the degree of biological fouling of a well.

Prior to drilling of a well, the water in the aquifer may be deficient in nutrients to support significant growth of bacteria of the type that creates biofouling. However, construction of the well provides increased air and the pumping of water from the well increases the aquifer water flow enough to bring nutrients to the well area to establish a growth environment for bacteria.

Air can enter the aquifer by diffusing down the well column, by the backflow of water when the pump is stopped, by diffusion both inside and outside of the well casing if the casing is improperly grout-sealed, and by infiltration to the water table during draw down. The enhanced water turbulence caused by pump operation increases the level of dissolved oxygen in the water. Consequently, the dissolved oxygen is increased at increased pumping rates, and the growth of aerobic bacteria is promoted accordingly.

SUMMARY OF THE INVENTION

The present invention is directed generally to a method and apparatus for inhibiting biological fouling of wells by replacing the air in the well column with an anoxic gas, thus depriving aerobic microorganisms of the oxygen that is necessary for the bacteria to flourish and lead to plugging of the well. In accordance with the invention, the air can be replaced only in the well itself without penetration of the anoxic gas into the aquifer. Alternatively, the anoxic gas can be used to displace the air in the well and can also penetrate into the aquifer to create a blanket of gas that prevents oxygen from dissolving in the water from the unsaturated soil cover in the vadose zone.

The air can be replaced by the anoxic gas by providing a seal in the well casing near the surface, by installing a gas supply pipe through the seal down into the well, and by supplying virtually any inert gas (such as nitrogen) to the gas pipe at a positive pressure level. The anoxic gas displaces the air in the well column, and the positive pressure is continuously maintained to prevent air from penetrating the anoxic gas atmosphere and reaching the water. If the well screen extends above the pumping water level or water table, the anoxic gas can penetrate into the aquifer through the screen. This is desirable in some applications because the nitrogen blankets the unsaturated soil cover in the vicinity of the well to prevent oxygen in the soil from dissolving in the water.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views:.

DETAILED DESCRIPTION OF THE INVENTION

Figure 1:
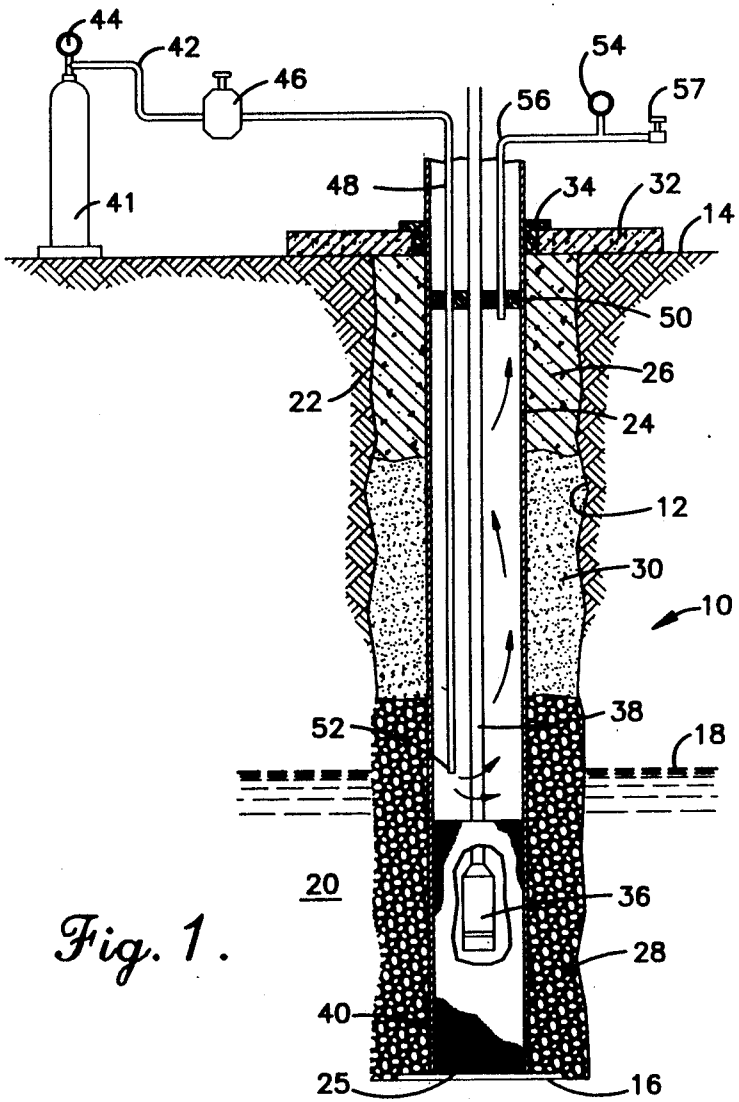
FIG. 1 is a sectional view of a water well diagrammatically illustrating equipment for displacing air in the well column with anoxic gas in accordance with the present invention.

Referring now to the drawings in more detail and initially to FIG. 1, numeral 10 generally designates a water well. The well 10 includes a borehole 12 which is drilled from the surface 14 and which terminates at a bottom 16 located below the water level 18 of the water table. The aquifer 20 has a vadose zone 22 above it around the borehole 12.

A column of well casing 24 is installed in the borehole 12 with an end plate 25 resting o its bottom. In the top section of the borehole 12, a concrete sleeve 26 is provided around the casing 24 in the annulus between the casing and the wall of the hole. Near the bottom 16 of the borehole, the area around the casing is packed with gravel 28. The concrete 26 may extend around the casing to the top of the gravel pack 28, or a different grout material 30 may be provided around the casing between the concrete 26 and the gravel pack 28. The grout material 30 may be Bentonite clay or another suitable material. A concrete slab 32 is located on the surface 14 around the well, and a sanitary seal 34 provides a seal between the well casing 24 and the slab 32.

Any type of well pump may be installed but illustrated is a submersible pump 36 in the casing 24 which is immersed in the water in the well at a location below the water level 18. The discharge side of the pump 36 connects with an outlet pipe 38 which extends vertically within the casing to the surface. After emerging from the well at the surface, the outlet pipe 38 connects with a suitable receptacle or appliance (not shown) for receiving the water that is pumped from the well.

Water is able to enter the well from the aquifer through a screen 40 or open hole located at the bottom end of the well casing 24 with end plate 25 attached. The screen 40 is surrounded by the gravel pack 28, and water is able to pass through the gravel pack and screen into the well column. The pump 36 may be located within the screen 40 or just above in casing 24.

Alternatively, the well casing 24 may be of larger diameter than the well screen 40 assembly and terminate at any point above the well screen 40 with an inner casing (not shown) attached.

Alternately the well may be void of a well screen 40 if the borehole 12 is constructed in a formation consolidated enough to remain open without caving in.

As thus far described, the well 10 is constructed in a conventional manner. The well column within the casing 24 is normally filled with air above the fluid level, and the air is thus made available to the water in the aquifer and can readily dissolve in it to promote the growth of aerobic bacteria which can lead to biological fouling of the well.

In accordance with the present invention, the air in the well column is replaced by an anoxic gas contained within a cylinder 41 which is located outside of the well at the surface. The anoxic gas is preferably inert and normally but not limited to gases lighter than air. Although various gases can be used, nitrogen is presently preferred because of its inert character, its characteristic of being lighter than air, and its commercial availability at a reasonable cost. However, it should be understood that any other anoxic gas such as carbon dioxide can be used.

The nitrogen is contained in the cylinder 41 under pressure or supplied by a nitrogen pump which purifies air and supplies greater than 99.5% nitrogen. An outlet pipe 42 extends from the cylinder 41 and is equipped with a pressure gauge 44 for gauging the pressure of the gas in the cylinder. The outlet pipe 42 leads to a pressure regulator 46 which can be adjusted to provide the desired gas pressure downstream from it. On the downstream side of the pressure regulator 46, a gas supply pipe 48 extends into the well casing 24. The supply pipe 48 extends downwardly in the well casing through a circular seal element 50 which is installed in the well casing 24 at a location near the surface 14. The seal element 50 provides a gas tight seal in the casing. The water pipe 38 extends through the seal element 5 which could be off center. The supply pipe 50 terminates in a lower end 52 which is located down in the well, preferably at a location slightly above the water level 18.

The pressure inside of the well casing 24 below the seal element 50 is monitored by a pressure gauge 54. Connected with the gauge 54 is a pipe 56 which extends downwardly through the seal element 50 and has an open end situated in the well casing 24 at a location immediately below the seal element 50.

In accordance with the present invention, the air which is initially present in the well column is replaced by the nitrogen supplied by the cylinder 41, and purged through pressure relief valve 57. The pressure regulator 46 is adjusted such that the nitrogen in the cylinder 41 is applied to the supply pipe 48 at a pressure that is preferably a few pounds per square inch above normal atmospheric pressure in the well column within the casing 24. The pressure gauge 54 monitors the pressure of the gas continuously in the well casing 24 below seal 50. By maintaining a slightly positive pressure of the anoxic gas in the supply pipe 48, the gas is able to enter the casing 24 near its bottom through the discharge end 52 of the supply pipe. Because the anoxic gas is, normally lighter than air, it flows upwardly and fills the casing up to the seal element 50, displacing the air in the process. When the pump 36 starts operation, the water level 18 inside well casing 24 draws down reducing the pressure inside casing 24. Inert gas from cylinder on pump 41 through pipe 42 and pressure regulator 46 restores pressure to casing 24 below well seal 50. When pump 36 stops, the water level 18 will rise in the casing 24 and excess gas pressure can be relieved through a pressure regulating valve 57. Because a slight positive pressure of the anoxic gas is maintained, air is unable to penetrate it and enter the well column.

Due to the displacement of the air by the anoxic gas, the water in the well is deprived of a significant source of oxygen that can dissolve in the water and promote the growth of aerobic microorganisms. The growth and development of such microorganisms are thus inhibited by the anoxic gas, and biofouling of the well is reduced significantly. As a consequence, the problems created by biofouling are reduced. For example, the pump 36 is not as prone to becoming clogged by biological masses, and it is not necessary to withdraw the pump for inspection, cleaning and/or replacement at frequent intervals, as can be necessary if the well becomes clogged with biomass. Also, the water discharge lines may be less prone to plugging.

Figure 2:
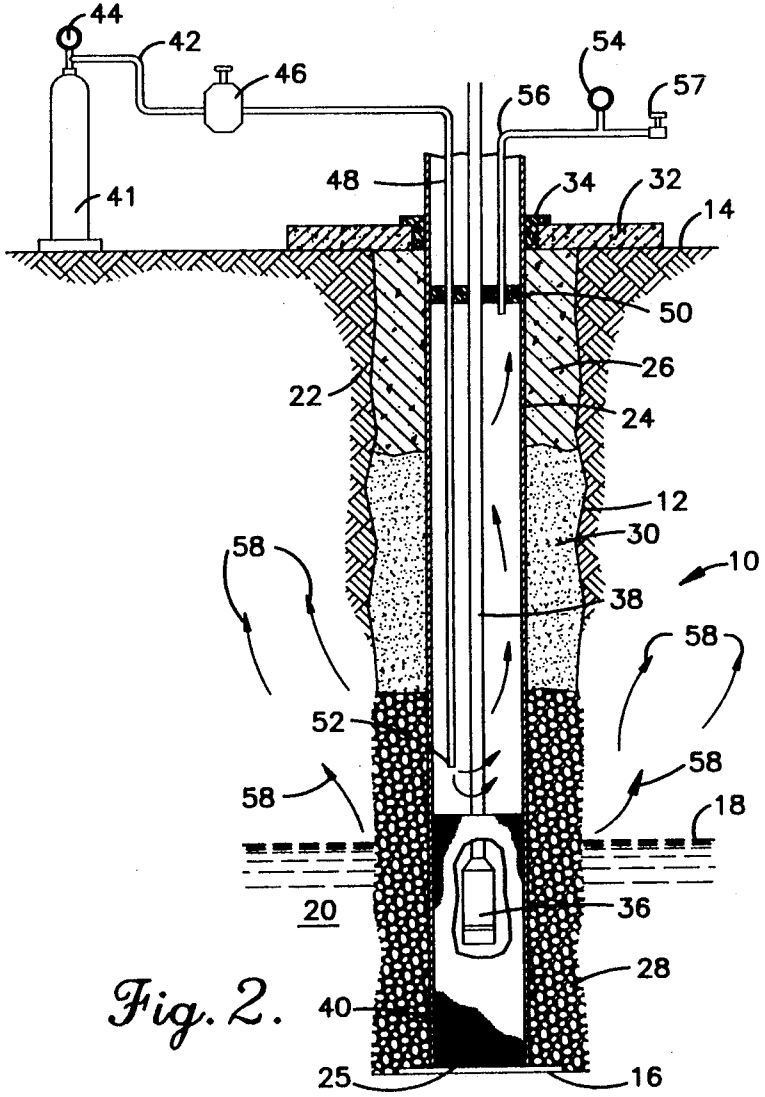
FIG. 2 is a sectional view similar to FIG. 1, but showing an arrangement in which the air in the well column is replaced by the anoxic gas and the anoxic gas is also applied to the aquifer in the vicinity of the well.

FIG. 2 depicts an arrangement that is identical to that of FIG. 1, except that the screen 40 in the embodiment of FIG. 2 extends in the well above the water level 18 of the water table. Consequently, the anoxic gas which is applied to the well is able to pass through the screen 40 and through the gravel pack 28 into the aquifer 20, as indicated by the directional arrows 58. The gas 58 can thus create a "blanket" in the aquifer 20 which prevents oxygen from penetrating it from the unsaturated soil cover in the vadose zone 22. Consequently, the oxygen in the vadose layer is prevented from dissolving into the water in the area around the well 10, and this further inhibits biological fouling of the well.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

We claim:

1. A method of controlling biological fouling of a water well bored down to a water table, said method comprising the steps of:

sealing the well at a preselected location therein; providing a source of anoxic gas at a location out of the well and above the surface; extending a gas supply conduit from said source down into the well to a location below said preselected location near the water table with said conduit having a single outlet located near the water table; and conveying the gas from the source and through the supply conduit at a positive pressure to displace air from the well and replace the air with said anoxic gas to inhibit aerobic bacteria growth.

2. The method of claim 1, wherein said anoxic gas is lighter than air.

3. In a water well having a well casing extending down to a water table and a submersible pump immersed in the well at a location in the casing below the water table for pumping water to the surface through an outlet pipe extending in the casing, a method of decreasing biological fouling of the pump comprising the steps of:

extending a gas supply conduit down into the well casing to a location near the water table with said conduit having a single outlet located near the water table;

sealing the well casing at a location near the surface; and applying an anoxic gas to said gas supply conduit at a positive pressure to force said anoxic gas through the supply conduit and into the well to displace air therefrom, thereby discouraging aerobic microorganism development in the water while making use of said casing to provide access to the well for said pump, outlet pipe and gas supply conduit.

4. The method of claim 3, wherein the anoxic gas is lighter than air.

5. The method of claim 3, wherein the anoxic gas is inert.

6. The method of claim 5, wherein the anoxic gas is lighter than air.

7. The method of claim 3, wherein the anoxic gas is predominantly nitrogen.

8. The method of claim 3, including the step of continuously applying the anoxic gas to said supply conduit at a positive pressure above atmospheric pressure to inhibit air penetration of the gas.

9. The method of claim 3, wherein the well has a well screen immersed partially in the water and extending above the water table in the aquifer, whereby the anoxic gas applied to the well can enter the aquifer outside of the well through said well screen.

10. Apparatus for controlling biological fouling of a water well having a well casing extending in the well and a submersible pump in the well immersed in water for pumping water to the surface through a water pipe, said apparatus comprising:

a source of anoxic gas located outside the well at the surface;

means for sealing the well casing at a selected location near the surface; and a gas supply conduit communicating with said gas source to receive the gas therefrom and extending through said seal means down into the well casing, said supply conduit having a single outlet at a discharge end thereof located in the well near the water for applying the gas to the well casing to displace air from the well casing and thereby impede aerobic bacteria development while making use of the well casing to provide access to the well for said pump, water pipe and gas supply conduit.

11. Apparatus as set forth in claim 10, wherein the anoxic gas is lighter than air.

12. Apparatus as set forth in claim 11, wherein the anoxic gas is predominantly nitrogen.

13. Apparatus as set forth in claim 10, wherein the anoxic gas is inert.

14. Apparatus as set forth in claim 13, wherein the anoxic gas is lighter than air.

15. Apparatus as set forth in claim 10, wherein said source is operable to supply the anoxic gas to the supply conduit at a positive pressure above atmospheric pressure to maintain the gas at said positive pressure for impeding penetration of the gas by air.

* * * * *

UNITED STATES PATENT AND TRADEMARK OFFICE

CERTIFICATE OF CORRECTION

PATENT NO. : 5,190,108

DATED : March 2, 1993

INVENTOR(S) : Neil MANSUY, ET AL.

It is certified that error appears in the above-identified patent and that said Letters Patent is hereby corrected as shown below:

On title page, item [75] add the following;

-- J.H. Sunderlin III, Lafayette, IN. --

Item [19] "Mansuy" should read --Mansuy, et al--

Signed and Sealed this

Seventh Day of December, 1993

*Attest:*

*Attesting Officer*

BRUCE LEHMAN

*Commissioner of Patents and Trademarks*